United States Patent [19]

Edleson

[11] 4,388,870

[45] Jun. 21, 1983

[54] BOWED PELLET PACK WARHEAD

[75] Inventor: Stuart K. Edleson, Dallas, Tex.

[73] Assignee: The United States of America as represented by the Secretary of the Navy, Washington, D.C.

[21] Appl. No.: 740,843

[22] Filed: Jun. 26, 1968

[51] Int. Cl.[3] ..... F42B 13/48

[52] U.S. Cl. ..... 102/494

[58] Field of Search ..... 102/7.2, 63, 89, 67, 102/389, 393, 394, 474, 491, 494, 504

[56] References Cited

U.S. PATENT DOCUMENTS

| | | | |
|---|---|---|---|
| 1,367,938 | 2/1921 | Bettica | 102/7.2 |
| 2,476,973 | 7/1949 | Gillon | 102/7.2 |
| 3,093,072 | 6/1963 | Pigman | 102/7.2 |
| 3,222,675 | 12/1965 | Schwartz | 102/63 |

*Primary Examiner*—Charles T. Jordan

*Attorney, Agent, or Firm*—Robert F. Beers; Joseph M. St. Amand; Thomas M. Phillips

[57] ABSTRACT

A bundle of tubular shaped pellets for a rotating warhead packaged in a wheel arrangement for uniform dispersion without coning upon release.

4 Claims, 4 Drawing Figures

BOWED PELLET PACK WARHEAD

This invention is related to copending U.S. patent application Ser. No. 626,655, filed Mar. 22, 1967 for Rotating Rod Warhead.

This invention is a component for use in an anti-satellite warhead, such as disclosed in the aforementioned copending application, which utilizes the principle of centrifugal dispersion of fragments from a spinning bundle. In operation of the warhead, it is necessary that the fragments remain aligned in their original orientation during dispersal, and the present invention is an important component to the proper functioning of such a warhead.

Warhead studies have demonstrated two basic principles for dispersing rod or tubular pellets without inducing coning. These may be briefly stated as:

first, the retaining of all pellets so that there is a positive mutual compressive force between all pellet ends (tips) in each face of the bundle of pellets through spin-up and release in order to stabilize all pellets parallel to the central shaft; and second, to restrain the pellet pack about its circumference at the central plane only, i.e., the plane which intersects the midpoint of the pellet lengths; with contact existing only at the pellet midpoints, asymmetries in restraint mechanism release action will not impose any endwise rotation (tilt) on the pellets as they are being released.

The prior invention of the aforementioned copending application Ser. No. 626,655 implemented the first of these principles with a "rocker beam" mechanism which utilized strong beams around the periphery of the bundle to distribute the central plane restraint force to the tips of the pellets. This restraint force had to be greater than centrifugal force by a surplus restraint increment, to maintain the pellet tips in contact with each other and the shaft while spinning. The middles of the pellets were allowed to deflect radially outward under centrifugal force. The rocker beams can be very complex and very heavy, and the instant invention which utilizes the second principle is an improvement over the rocker beam method and the strength of the pellets themselves are utilized to effect the load distribution function.

The instant invention is for a pellet pack which provides proper dispersing without coning, wherein an inwardly acting radial force at the central plane around the circumference of the pack is provided which equals the centrifugal force.

Other objects and many of the attendant advantages of this invention will become readily appreciated as the same becomes better understood by reference to the following detailed description when considered in connection with the accompanying drawings wherein.

Figure 1:
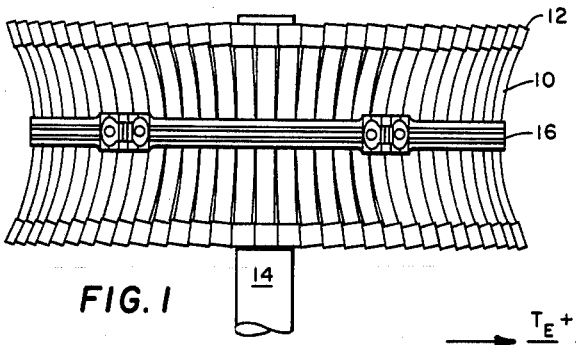
FIG. 1 is a side view of a pellet pack of the present invention.

As shown in FIG. 1, a bundle of rod-shaped pellets 10 having enlarged diameter tips 12 is mounted about a shaft 14 by means of a circumferential restraining band 16, such as disclosed in copending U.S. patent application Ser. No. 740,842 filed June 26, 1968 for Instantaneous Tension Load Release Device.

Figure 2:
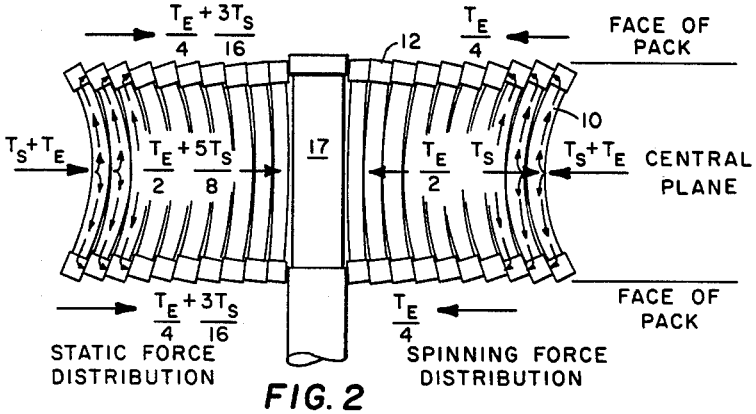
FIG. 2 is a schematic diagram of FIG. 1 in cross-section showing force distribution, on the tubular rod-shaped pellets of the warhead pack.

In assembling a pack of pellets 10 about shaft 14 tooling bands are applied to the circumference of the pack and tightened to hold the pack in shape for installation of the restraint band 16 about the mid-section of the pack. The pack of pellets is compressed to where the centers of the pellets are touching, along the central plane of the pack, as shown in FIG. 2, and restraining band 16 retains pellets 10 in their bowed configuration with their centers in contact and against the hub of shaft 14. When rotated to desired speed and released, the pellets will be dispersed without coning in a uniform manner similar to that disclosed in aforementioned patent application Ser. No. 626,655.

For a more complete understanding of the invention, the following explanation and analysis is given.

The pellet pack configuration shown schematically in FIG. 2 may be most easily understood by first considering all pellets 10 and the shaft 14 as straight metal cylinders, constrained by a rigid inward radial force at the central plane around the circumference of the pack, and that this restraint force exactly equals centrifugal force. The outer pellets must be capable of resisting this restraint force without local crushing at their centers. Under non-spinning (static) conditions, this restraint force will be absorbed by compression between pellet centers throughout the pack. This compression will have both radial and circumferential components. The central plane of the pack may be considered as a slice through a fluid under pressure within a pipe, the pipe representing the circumferential restraint forces.

When the pack is now spun up to speed, there will be a redistribution of the compressive forces within the pack. While spinning, these compressive forces will vary linearly from zero at the center to a maximum at the periphery. The net integration of the radial components of these compressive forces will equal the total centrifugal force. The central plane may still be considered as a slice of fluid in a pipe, now spinning. For the present, consider the fluid (cross section of the pellet centers) to be incompressible.

Now consider the effects of this spinning in a radial plane normal to the central plane, the section of the pack represented by FIG. 2. Constraint of the mass of pellets is provided by restraint forces acting at the central plane as previously described. The pellet ends, however, are not so constrained. They are free to deflect radially outward under centrifugal forces. Each pellet, therefore, becomes bowed, the tips displaced radially outward relative to the centers, when the mass of pellets is rotated. The magnitude of this end deflection is directly proportional to the radius of the pellet from the center of rotation, since the centrifugal force is directly proportional to the radius. Each pellet will be bowed just a little more than its next inward radial neighbor, so that all of the ends have lost contact. At the faces of the pellet pack (planes of the pellet ends) it will appear that the pellets have started to disperse, with all pellets still perfectly patterned, all center to center distances exactly equal, but with a slight space now between all adjacent pellet ends. These spaces will all be exactly equal. Now assume that the outside diameters of the pellet ends are enlarged so that this slight space between the pellet ends is exactly filled and the pellet ends are once again in contact but with zero forces between them. This is illustrated by the schematic diagram of FIG. 3 where the end radius of each individual pellet is increased by an amount equal to half of the space between it and its neighboring pellets. If, without any change in the circumferential restraint force, the spinning pack is stopped, all pellets will necessarily retain the same amount of bow or end deflection. However, the forces between ends will no longer be zero, but the circumferential restraint force will be reacted by compression between both the ends and centers of the pellets.

Consider now that the ends of the pellets are equally increased in radius somewhat more than that increment required to just maintain contact under spinning conditions. If the centers are held in contact while spinning, each pellet will now be bowed more than it would be by centrifugal force alone and there will be residual positive forces between pellet tips. To resist this additional bending and maintain the centers of the pellets in contact with each other and the shaft will now require a total restraint force greater than that required by centrifugal force alone. The additional increment will be called "additional restraint force". The centers must be held in contact to maintain symmetry and balance of the pack.

Under centrifugal force, it has been shown that the pellet tips deflected radially only, but that, due to geometry, the circumferential spacing between the tips increased by an equal amount. Because of this same geometry, the reverse is also true. Thus a further increase in the spacing between pellet ends resulting from an additional increase in tip diameter will force an additional bow in the pellets in radial planes only.

Since bow due to both centrifugal force and excess tip diameter thus occurs in the radial plane only, it is possible to evaluate the net effect of one in terms of the other.

Under centrifugal force, all pellet tips deflect outward in proportion to their radius from the center of rotation. The restraint required to maintain their centers in place must be proportional to the tip deflection within the elastic limit. The restraint required for each pellet is thus proportional to its radius from the center. The summation of these restraint forces equals the total centrifugal force.

Similarly, if the ends of all pellets are equally increased in diameter by more than the space between them under spinning conditions while the centers are maintained in contact, the pellets will be bowed more than by centrifugal force alone. The magnitude of the additional tip deflection in each will, by geometry, be proportional to its radius from the center. Again this additional tip deflection will require an additional center restraint force to bend the pellet as a beam and maintain its center in contact with the others. This additional center force will, within the elastic limit, be proportional to its additional tip deflection, and thus proportional to radius from the center.

The ratio of the summation of these additional restraint forces, due to excess tip diameter, to the summation of the centrifugal forces will be the same as the ratio of the additional force required to restrain the center of any one pellet, against the additional deflection, to the centrifugal force of that same pellet. Stated algebraically:

$$F_e/F_s=\Sigma f_e/f_s=f_e/f_s$$

Analysis:

$F_s$=total centrifugal (spin) force of the pellet pack, equal to $2\pi T_s$ $F_e$=total additional (excess) force exerted radially by the additional deflection of the pellets, equal to $2\pi T_e$ $F_t$=total radial force exerted by the spinning pellets $\delta_s$=radial deflection of a pellet tip due to centrifugal force $\delta_e$=additional deflection of a pellet tip to provide positive compressive forces between pellet ends while spinning $\delta_t$=total deflection of a pellet tip while spinning $f_s$=radial reaction of a single pellet due to spinning of the pack $f_e$=radial reaction of a single pellet due to additional deflection $\Delta$=increase in diameter of pellet ends over pellet centers N=R/d=radius of the center of any pellet from the center of rotation, divided by the diameter of the middle of the pellet.

Figure 4:
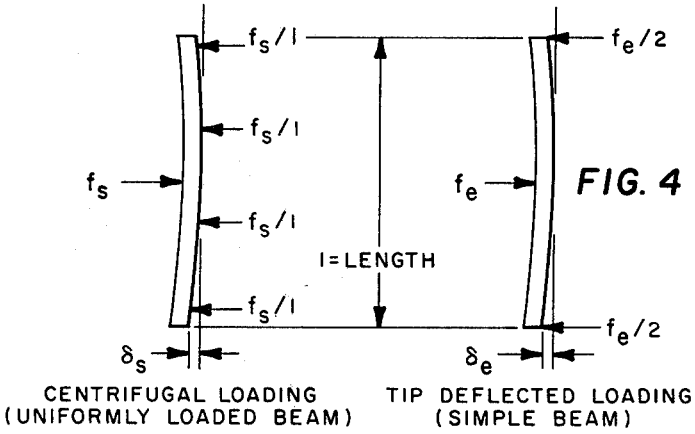
FIG. 4 is a diagram showing load-deflection characteristics of a pellet under centrifugal and tip deflection loads.

Observing the diagram of FIG. 4, consider the load-deflection characteristics of a pellet under centrifugal and tip deflected loads:

| Centrifugal Loading (uniformly loaded beam) | Tip Deflected Loading (Simple beam) |
|---|---|
| $\delta_s = \dfrac{\frac{f_s}{2}(\frac{1}{2})^3}{8EI}$ | $\delta_e = \dfrac{\frac{f_e}{2}(\frac{1}{2})^3}{3EI}$ |

If $f_e=f_s$, then $\frac{3}{8}\,\delta_e=\delta_s$.
If $\delta_e=\delta_s$, then $f_e=\frac{3}{8}\,f_s$; or $$8\delta_s/3\,\delta_e=f_s/f_e$$

$$F_s=\Sigma f_s=2\pi T_s$$

$$F_e=\Sigma f_e=2\pi T_e$$

$$f_s/f_e=T_s/T_e=8\,\delta_s/3\,\delta_e$$

Therefore $T_e=(\delta_e/\delta_s)\,\frac{3}{8}T_s$. This expression relates the additional tension, $T_e$, required in a restraint band, due to additional pellet tip enlargement, to the band tension, $T_s$, required to restrain centrifugal force, in terms of the ratio of additional tip deflection to centrifugal tip deflection for any individual pellet. From the above:

$$\delta_e=(8/3)\delta_s(T_e/T_s)$$

$$\delta_s+\delta_e=\delta_t=\delta_s(1+8T_e/3T_s)$$

$$N\Delta=\delta(\text{from geometry, FIG. 3})$$

Therefore $\Delta_t=(\delta_s/N)(1+8T_e/3T_s)$.

If $T_e$ in the above equation is made equal to $T_E$ from the splice joint analysis, then $\Delta_t$ will be the maximum average increase in pellet tip diameters without exceeding the design total tension in the restraint band.

$\Delta_s=\delta_s/N$ will be the minimum average increase in pellet tip diameters to just provide tip contact at spin speed, with no net force between pellet tips. The excess tension, $T_E$, in the band will then be dissipated in compression of the pellet centers.

Thus, if $\Delta_t$ and $\Delta_s$ are set up as the limits of $\Delta$, the actual forces between pellet tips, at speed, will lie somewhere between zero and the maximum allowable.

Thus, when the total centrifugal force of the spinning pack is calculated and a restraint band designed, defining $T_S$ and $T_E$, the maximum allowable average increase in pellet tip diameter can be determined by calculating the tip deflection due to centrifugal force, for any individual pellet, as follows:

w=weight of a single pellet
g=acceleration of gravity
l=length of pellet
d=diameter of pellet center
$d_i$=inside diameter of tubular pellet
$\gamma$=specific weight density, weight per unit volume, of pellet material
E=modulus of elasticity of pellet material
$\omega$=spin rotational velocity, radians per unit of time
I=moment of inertia of pellet cross section, about bending axis From the above:

$$\delta_s = \frac{\frac{f_s}{2}(\frac{l}{2})^3}{8EI} = \frac{f_s l^3}{128EI}$$

$$f_s = \frac{w}{g} R\omega^2$$

$$w = \frac{\gamma\pi l(d^2 - d_i^2)}{4}$$

$$R = Nd$$

$$I = \frac{\pi}{64}(d^4 - d_i^4) = \frac{\pi}{64}(d^2 + d_i^2)(d^2 - d_i^2)$$

therefore $$\delta_s = \frac{\gamma\pi l(d^2 - d_i^2)}{4g} Nd\omega^2 \frac{l^3}{128E\frac{\pi}{64}(d^2 + d_i^2)(d^2 - d_i^2)}$$

$$\delta_s\, 32\ \gamma l^4\omega^2 \frac{Nd}{9gE(d^2 + d_i^2)}$$

or $$\frac{\delta_s}{N} = \frac{\gamma l^4\omega^2 d}{8gE(d^2 + d_i^2)}$$

thus $$\Delta_t = \frac{\gamma l^4\omega^2 d}{8gE(d^2 + d_i^2)}\left(1 + \frac{8T_E}{3T_S}\right)$$

These same formulae may be used to determine the maximum bending stress in the outermost pellet, to assure that it is within the elastic limit.

$$\text{Stress} = \sigma_t = \sigma_s + \sigma_e = \frac{M_s\frac{d}{2}}{I} + \frac{M_e\frac{d}{2}}{I}$$

$$\sigma_t = \frac{d}{2I}(M_s + M_e)$$

where $M_s$=bending moment due to spin
$M_e$=bending moment due to additional deflection
$M_s=(f_s/2)\frac{l}{4}$ and $M_e=(f_e/2)\frac{l}{2}$ therefore $$\sigma_t=(dl/8I)(f_s/2+f_e)$$

but $f_s=\delta_s\, 128\, EI/l^3$ and $f_e=\delta_e 48\, EI/l^3$ and $\delta_e=(8/3)\delta_s(-T_E/T_s)$ therefore $f_e=(\delta_s\ 128\ EI/l^3)(T_E/T_s)$ and $\sigma_t=(dl/8I)(\delta_s\, 128\, EI/l^3)(\frac{1}{2}+T_E/T_s)$ but $$\delta_s = \gamma l^4\omega^2 \frac{R}{8gE(d^2 + d_i^2)}$$

therefore $$\sigma_t = \frac{dl}{8I}\ \frac{128EI}{l^3}\ \gamma l^4\omega^2 \frac{R}{8gE(d^2 + d_i^2)}\left(\frac{1}{2} + \frac{T_E}{T_S}\right)$$

or $$\sigma_t = \frac{2dl^2\omega^2 R\gamma}{g(d^2 + d_i^2)}\left(\frac{1}{2} + \frac{T_E}{T_S}\right)$$

where R is the radius of the center of the outermost pellet from the center of rotation.

Figure 3:
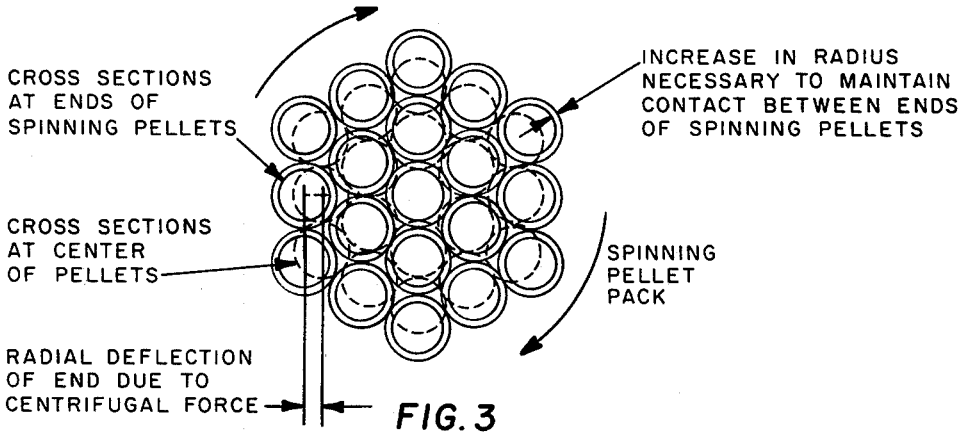
FIG. 3 is a schematic diagram of the ends of a bundle of tubular pellets illustrating the increased diameter of the pellet ends and increased bowing of the pellets as the distance increases from the center.

The foregoing design is based upon the assumption that the pellet pack is built up around a single central pellet, which will not bend such as illustrated by FIG. 3. All other pellets have their tips deflected radially as specified by the analysis. The hub 17 of central shaft 14 in fact replaces some desired grouping of pellets in the center of the pack. The ends and the center of hub 17 is configured to support the surrounding pellets in their deflected form as shown in FIG. 2. Thus the hub radius from the center of rotation to the support point for the middle of any pellet is:

$$R-d/2$$

and the hub radius to support the tip of this same pellet is:

$$R + \frac{R}{d}\Delta - \frac{(d + \Delta)}{2}$$

or $$R - \frac{d}{2} + \Delta\left(\frac{R}{d} - \frac{1}{2}\right)$$

where $\Delta$ is the mean of the limits specified for construction.

What is claimed is:

1. A rotating warhead for rapidly dispersing a plurality of pellets in a desired pattern without coning, comprising:

(a) a shaft, operable to be rotated at a desired speed, having a hub thereon, (b) a substantially large number of elongated rod-shaped pellets assembled in a symmetrical bundle about said shaft hub, (c) a releasable circumferential restraining means for compressing said pellets together and about said shaft hub in a touching relationship in the central plane of said symmetrical bundle normal to said shaft hub causing all said pellets to bow toward said shaft, (d) said circumferential restraining means retaining said bundle of pellets about said shaft hub to be rotated therewith until released for rapid dispersion.

2. A rotating warhead as in claim 1 wherein the ends of said pellets are of slightly larger diameter than the diameter of their mid-sections.

3. A rotating warhead as in claim 1 wherein the bow in said pellets increases with the radial distance from said shaft hub.

4. A rotating warhead as in claim 1 wherein said pellets are tubular rods having a larger diameter at the ends than at the mid-section.

* * * * *